US008779697B2

(12) United States Patent
Baurichter et al.

(10) Patent No.: US 8,779,697 B2
(45) Date of Patent: Jul. 15, 2014

(54) RF CAVITY AND ACCELERATOR HAVING SUCH AN RF CAVITY

(75) Inventors: Arnd Baurichter, Odense (DK); Oliver Heid, Erlangen (DE); Timothy Hughes, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/510,120

(22) PCT Filed: Oct. 18, 2010

(86) PCT No.: PCT/EP2010/065595

§ 371 (c)(1),
(2), (4) Date: May 16, 2012

(87) PCT Pub. No.: WO2011/061026

PCT Pub. Date: May 26, 2011

(65) Prior Publication Data

US 2012/0229054 A1 Sep. 13, 2012

(30) Foreign Application Priority Data

Nov. 17, 2009 (DE) ..... 10 2009 053 624

(51) Int. Cl.
*H05H 9/00* (2006.01)

(52) U.S. Cl.
USPC ..... 315/505; 315/500; 315/370

(58) Field of Classification Search
CPC ..... H05H 1/38
See application file for complete search history.

(56) References Cited

U.S. PATENT DOCUMENTS

| | | | | |
|---|---|---|---|---|
| 2,563,585 A | | 8/1951 | Dallenbach | 315/5 |
| 2,860,313 A | * | 11/1958 | Israel | 336/110 |
| 3,495,125 A | * | 2/1970 | Koontz | 333/35 |
| 5,497,050 A | * | 3/1996 | Cheo | 315/5.41 |

(Continued)

FOREIGN PATENT DOCUMENTS

| | | | |
|---|---|---|---|
| CN | 1582529 A | 2/2005 | H03F 3/60 |
| DE | 1739053 U | 2/1957 | |

(Continued)

OTHER PUBLICATIONS

Examination Report, German Patent Application No. 10 2009 053 624.8-54, 5 pages, Aug. 10, 2010.

(Continued)

*Primary Examiner* — Douglas W Owens
*Assistant Examiner* — Srinivas Sathirau
(74) *Attorney, Agent, or Firm* — King & Spalding L.L.P.

(57) ABSTRACT

An RF cavity includes a chamber, a conductive wall that encloses the chamber and has an inner side and an outer side, a switch arrangement comprising a plurality of solid-state switches arranged along a circumference of the wall around the chamber, wherein the solid-state switches are connected to the conductive wall such that RF currents are induced in the conductive wall when the switch arrangement is activated, as a result of which RF power is coupled into the chamber of the RF cavity, and a shielding device located on the outer side of the conductive wall, along a circumference of the RF cavity, the shielding device configured to increase the impedance of a propagation path of RF currents along the outer side of the wall such that the RF currents coupled into the wall are suppressed on the outer side of the wall.

16 Claims, 3 Drawing Sheets

(56) References Cited

U.S. PATENT DOCUMENTS

| | | | | |
|---|---|---|---|---|
| 5,661,366 | A * | 8/1997 | Hirota et al. | 315/5.41 |
| 5,917,293 | A * | 6/1999 | Saito et al. | 315/505 |
| 6,724,261 | B2 | 4/2004 | Cheo | 330/295 |
| 7,710,051 | B2 * | 5/2010 | Caporaso et al. | 315/505 |
| 8,232,747 | B2 * | 7/2012 | Crewson et al. | 315/505 |
| 8,325,463 | B2 * | 12/2012 | Peterson | 361/502 |
| 2009/0224700 | A1 * | 9/2009 | Chen et al. | 315/505 |
| 2010/0049152 | A1 * | 2/2010 | Lalomia et al. | 604/319 |

FOREIGN PATENT DOCUMENTS

| | | | | |
|---|---|---|---|---|
| EP | 0711101 | A1 | 5/1996 | H05H 7/02 |
| JP | 9208391 | A | 8/1997 | C01G 1/00 |
| JP | 2005019508 | A | 1/2005 | B01J 19/08 |
| JP | 4268799 | B2 | 5/2009 | A61L 2/06 |

OTHER PUBLICATIONS

International PCT Search Report and Written Opinion, PCT/EP2010/065595, 12 pages, Apr. 14, 2011.

* cited by examiner

RF CAVITY AND ACCELERATOR HAVING SUCH AN RF CAVITY

CROSS-REFERENCE TO RELATED APPLICATIONS

This application is a U.S. National Stage Application of International Application No. PCT/EP2010/065595 filed Oct. 18, 2010, which designates the United States of America, and claims priority to DE Patent Application No. 10 2009 053 624.8 filed Nov. 17, 2009. The contents of which are hereby incorporated by reference in their entirety.

TECHNICAL FIELD

The disclosure relates to an RF cavity into which RF power can be coupled in order to generate an electromagnetic field inside the RF cavity. The disclosure also relates to an accelerator comprising such an RF cavity. Such accelerators, or such RF cavities, are conventionally used for accelerating charged particles.

BACKGROUND

RF cavities are known which can be excited into RF resonance by coupling RF power into the RF cavity. The RF power itself, however, is generated at a distance from the RF cavity, for example with the aid of a klystron, and transported to the RF cavity with the aid of a waveguide. As an alternative, it is possible to couple the RF power into the cavity with the aid of an antenna or an inductive coupler.

U.S. Pat. No. 5,497,050 discloses a different structure for coupling RF power into an RF cavity. This is done using a multiplicity of solid-state power transistors, which are integrated in a conductive wall of the RF cavity.

SUMMARY

In one embodiment, an RF cavity comprises: a chamber, a conductive wall which encloses the chamber and has an inner side and an outer side, and a switch arrangement comprising a multiplicity of solid-state switches, which are arranged along a circumference of the wall around the chamber, the solid-state switches being connected to the conductive wall so that RF currents are induced in the conductive wall when the switch arrangement is activated, as a result of which RF power is coupled into the chamber of the RF cavity, wherein on the outer side of the conductive wall, along a circumference of the RF cavity, there is a shielding device which increases the impedance of a propagation path of RF currents along the outer side of the wall so that the RF currents coupled into the wall are suppressed on the outer side of the wall.

In a further embodiment, the conductive wall comprises a first section and a second section insulated from the first section, and the shielding device comprises a first part and a second part, the first part being arranged on the first section of the conductive wall and the second part being arranged on the second section of the conductive wall. In a further embodiment, the insulation between the first section and the second section of the conductive wall is a vacuum seal.

In a further embodiment, the shielding device comprises a ribbed conductive structure. In a further embodiment, the shielding device comprises a ferrite ring. In a further embodiment, the shielding device comprises a λ/4 spur line. In a further embodiment, at least a part of the shielding device is sunk into a recess on the outer side of the conductive wall. In a further embodiment, a λ/4 spur line is formed by the recess in the conductive wall. In a further embodiment, the recess is filled with a dielectric. In a further embodiment, the λ/4 spur line is folded.

In a further embodiment, the solid-state switches are enclosed by a protective cage which is connected to the outer side of the conductive wall at one point, so that the shielding device lies between the point and the position where the RF currents are coupled into the wall by the solid-state switches. In a further embodiment, at least a part of the shielding device is applied on the outer side of the conductive wall. In a further embodiment, the shielding device is formed by a conductive protective cage, which encloses the solid-state switches and the inner side of which is ribbed. In a further embodiment, the RF cavity is formed as a coaxial electrical line. In a further embodiment, the RF cavity is formed as an RF resonator, in particular for accelerating particles.

In another embodiment, an accelerator comprises a plurality of RF cavities as disclosed herein, wherein the plurality of RF cavities can be controlled independently of one another.

BRIEF DESCRIPTION OF THE DRAWINGS

Example embodiments will be explained in more detail below with reference to figures, in which.

DETAILED DESCRIPTION

Figure 1:
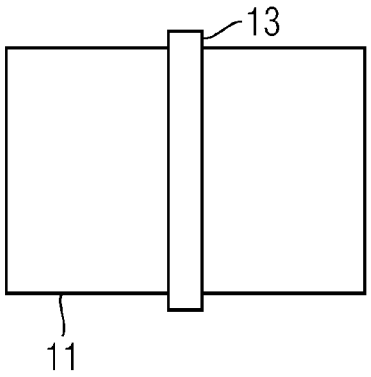
FIG. 1 and FIG. 2 show a schematic overview of a cylindrical RF cavity comprising an input coupling device arranged along its circumference for the input coupling of RF power.

Some embodiments provide an RF cavity which can be operated reliably and which can be used safely together with other equipment. Other embodiments provide an accelerator comprising such an RF cavity, which allows flexible driving.

In some embodiments, an RF cavity comprises:

- a chamber
- a conductive wall which encloses the chamber and has an inner side and an outer side, and
- a switch arrangement comprising a multiplicity of solid-state switches, which are arranged along a circumference of the wall around the chamber,
- the solid-state switches being connected to the conductive wall so that RF currents are induced in the conductive wall when the switch arrangement is activated, as a result of which RF power is coupled into the chamber of the RF cavity,
- on the outer side of the conductive wall, along a circumference of the RF cavity, there being a shielding device which increases the impedance of a propagation path of RF currents along the outer side of the wall so that the RF currents coupled into the wall are suppressed on the outer side of the wall.

Certain embodiments are based on the discovery that an accelerator structure, e.g., as disclosed in U.S. Pat. No. 5,497,050, is advantageous for coupling RF powers into an RF cavity. The area through which the RF power can be coupled in is greater in comparison with structures comprising input coupling merely at one point, since the transistors extend over the entire circumference. Furthermore, the RF power to be coupled in is generated in the immediate vicinity of the RF cavity, so that losses are avoided.

It has, however, furthermore been found that this structure can be problematic. In particular, the RF power which is coupled into the wall of the RF cavity generates strong RF currents on the outer side of the conductive wall. These RF currents constitute a problem during operation when there is a high power demand.

Owing to the fact that a shielding device is now provided, by which the impedance on the outer side of the conductive wall is increased, the RF currents which would otherwise propagate along a propagation path on the outer wall are significantly reduced, and in the best case are even entirely suppressed. The effect of the impedance increase on the outer side of the conductive wall is that the RF currents which are induced through the direct connection of the solid-state switches with the conductive wall propagate predominantly or entirely on the inner side of the conductive wall.

A number of advantages may be achieved as a result of this. The fact that no RF currents propagate on the outer side of the wall, and on an optionally provided protective cage around the transistors, avoids emission of electromagnetic radiation outward from the wall which would otherwise reduce the availability of the power and, for example, would interfere with operation owing to interruption of radiofrequency bands.

The outer side of the conductive wall can now be set at ground potential, so that the RF cavity can more easily be connected or coupled to other equipment and used together therewith. An outer side of the conductive wall at ground potential increases safety during operation.

The conductive wall usually comprises a first section and a second section insulated from the first section. The shielding device comprises a first part and a second part, the first part being assigned to the first section of the conductive wall and the second part being assigned to the second section of the conductive wall. The switch arrangement comprising the solid-state transistors supplies the RF power through a slot between the first section and the second section of the conductive wall. The insulation between the first section and the second section of the conductive wall may simultaneously fulfill the function of a vacuum seal.

The shielding device may achieve the impedance increase in a variety of ways. For instance, the shielding device may comprise a ribbed conductive structure, a ferrite ring and/or a $\lambda/4$ spur line.

Advantageously, the conductive wall may comprise a recess on the outer side, into which the shielding device is at least partially sunk.

In particular, a $\lambda/4$ spur line may be formed by the recess in the conductive wall. In this way, no additional material is required in order to achieve the impedance increase. Filling the recess with a dielectric makes it possible to match the spur line to the frequency of the RF currents. The spur line can be arranged compactly when the spur line is folded on itself, for example in the manner of a spiral.

The solid-state switches may additionally be enclosed by a conductive protective cage which is connected to the outer side of the conductive wall. This makes it possible to shield the solid-state switches against electromagnetic radiation. The point where the protective cage is connected to the conductive wall may be selected so that the shielding device lies between this point and the position where the RF currents are coupled into the conductive wall by the solid-state switches. In this way, the part of the conductive wall where RF currents can flow on the outer side lies inside the protective cage.

The shielding device need not necessarily be arranged in a recess of the conductive wall. It may also be applied entirely or partially on the outer side of the conductive wall.

The shielding device may also be formed by the conductive protective cage, which encloses the solid-state switches and is connected to the conductive wall. The protective cage is connected to both the first section and the second section of the conductive wall. Without ribs for increasing impedance on the inner side of the protective cage, in the absence of further measures such as a further shielding device of the protective cage, the protective cage would constitute a short circuit between the first section and the second section of the conductive wall. By virtue of the ribs, however, an impedance increase is achieved in the RF range, which prevents this. Furthermore, suppression of the RF currents on the outer side of the wall is achieved by the conductive protective cage, since propagation of the RF currents on the outer side of the conductive wall is prevented by the points of contact of the protective cage with the conductive wall.

The RF cavity may be formed as an RF resonator, which may be used in particular for accelerating particles. In particular, a plurality of such RF resonators may be connected in series and, in particular, driven independently of one another.

Owing to the fact that no RF currents flow on the outer side of the RF cavity, a plurality of these RF cavities can be connected in series to form an accelerator unit. Despite being coupled to one another, the RF cavities are then decoupled from one another in the radiofrequency range. The coupling relates merely to a direct-current component (DC component). Owing to the RF decoupling, moreover, it is then possible to drive the individual RF cavities independently of one another, so that the accelerator can be operated more flexibly and adapted more flexibly to the respectively desired acceleration to be achieved. The adaptation is more flexible than for an accelerator in which the RF cavities are coupled to one another in the RF range, so that controlling one RF cavity simultaneously influences the RF fields in the neighboring RF cavity.

In some embodiments, the structure for the input coupling of RF power and for shielding from the external environment may, however, also be used in other RF cavities; for example, the RF cavity may be formed as a coaxial electrical line or arranged in a re-entrant resonator structure.

FIG. 1 shows a side view of an RF cavity 11. An input coupling device 13 for coupling RF power into the RF cavity 11 is arranged around the outer circumference of the RF cavity 11.

Figure 2:
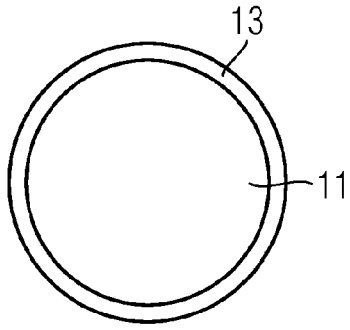

FIG. 2 shows a front view of the RF cavity 11 shown in FIG. 1.

Figure 3:
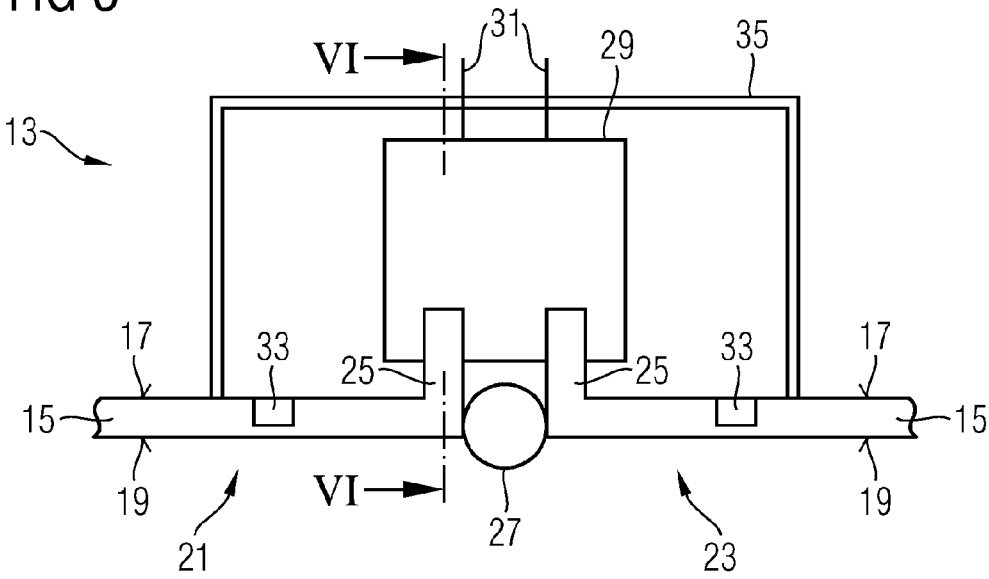
FIG. 3 shows a longitudinal section through an RF cavity with a detailed representation of the input coupling device, which comprises a shielding device formed as a ferrite ring.
Figure 4:
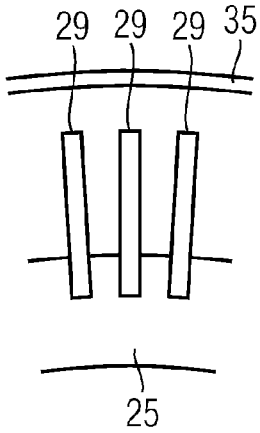
FIG. 4 shows a cross section through the RF cavity shown in FIG. 3 along the line III-III.

The input coupling device 13 will be presented in more detail with the aid of the longitudinal section in FIG. 3 and the cross section in FIG. 4 through the RF cavity 11 shown in FIG. 1 and FIG. 2.

FIG. 3 shows a longitudinal section through the RF cavity 11. Only one wall side of the RF cavity 11, in the region where the input coupling device 13 is located, is represented. A conductive wall 15 can be seen, which comprises a first section 21 and a second section 23 that are insulated from one another. The annular insulation 27 simultaneously forms a vacuum seal. The conductive wall 15 has an inner side 19, which faces toward the hollow space of the RF cavity 11, and an outer side 17 facing outward. The input coupling device 13 for RF power is located on the outer side 17. It comprises a multiplicity of solid-state transistors 29, which are in direct contact with a slot-like flange 25 that is formed by the first section 21 and the second section 23 of the conductive wall 15. The solid-state transistors 29 are connected via supply lines 31 to a DC current source (not shown here). When activated, the solid-state transistors 29 induce RF currents in the conductive wall 15, which propagate along the conductive wall 15. Propagation along the inner side of the conductive wall is desired. In order to achieve this, a shielding device is provided, which in the case shown here is incorporated into a recess of the conductive wall 15. In the exemplary embodiment shown here, the recesses are filled with a ferrite ring 33. The shielding device, or the ferrite ring 33, is located both in the first section 21 of the conductive wall 15 and in the second section 23. The ferrite ring 33 increases the impedance on the outer side 17 of the electrically conductive wall 15, so that propagation of RF currents along the outer side 17 is prevented and directed onto the inner side 19.

In addition, the solid-state transistors 29 and the input coupling point at the flange 25 are externally protected against electromagnetic radiation by a metallic protective cage 35, for example consisting of copper. The protective cage 35 makes contact with the electrically conductive wall 15 at a point on the outer side 17 which is already protected against propagating RF currents by the shielding device.

FIG. 4 shows a cross section along the line IV-IV in FIG. 3. The outer protective cage 35, some solid-state transistors 29 and the part of the conductive wall 15 forming the point of contact with the flange 25 can be seen.

In FIG. 3, the shielding device is shown as a ferrite ring 33 which extends along the circumference of the RF cavity. Further embodiments will be presented with the aid of the following FIG. 5 to FIG. 9.

Figure 5:
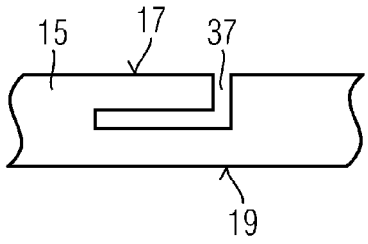
FIG. 5 shows an enlargement of a part of a longitudinal section through a wall of an RF cavity in order to represent a shielding device formed as a λ/4 spur line, FIG. 6 and FIG. 7 respectively show a different embodiment of the λ/4 spur line shown in FIG. 5.
Figure 6:
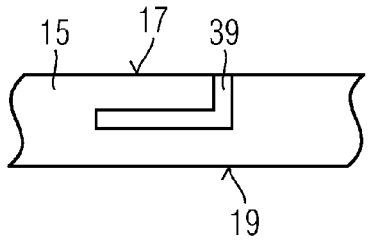
Figure 7:
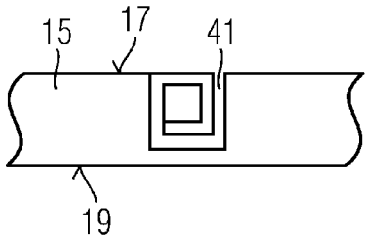

FIG. 5 shows a longitudinal section of the conductive wall 15 at a point which corresponds to the point in FIG. 3 where the ferrite rings 33 is located. A recess 37, which is shaped in such a way that it forms a $\lambda/4$ spur line, is incorporated in the conductive wall 15. The $\lambda/4$ spur line is tuned to the operating frequency of the RF cavity so that propagation of RF currents along the outer side 17 of the wall 15 is prevented by the $\lambda/4$ spur line. The recess may be filled with a dielectric 39 according to FIG. 6, or folded on itself according to FIG. 7 (fold 41). The $\lambda/4$ spur line can be accommodated compactly by both measures.

Figure 8:
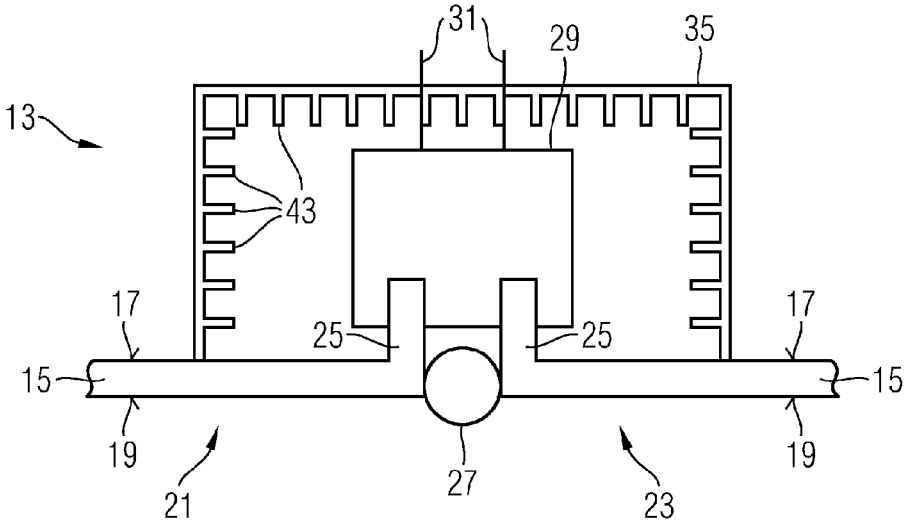
FIG. 8 shows a longitudinal section through an RF cavity, in which the protective cage arranged around the power transistors and comprising internal ribs is used as a shielding device.

FIG. 8 shows a further configuration of the shielding device. In the case shown here, the shielding device is produced by forming in a special way the protective cage 35, which makes contact with the conductive wall 15 and encloses the solid-state transistors 29. The protective cage 35 has a multiplicity of ribs 43 on its inner side. With the aid of these ribs 43, the impedance of the path which leads from the outer side 17 of the conductive wall 15 along the inner side of the protective cage 29 is increased, so as to prevent RF currents from propagating along the outer side 17 of the wall 15 from the injection point to beyond the protective cage 29.

Figure 9:
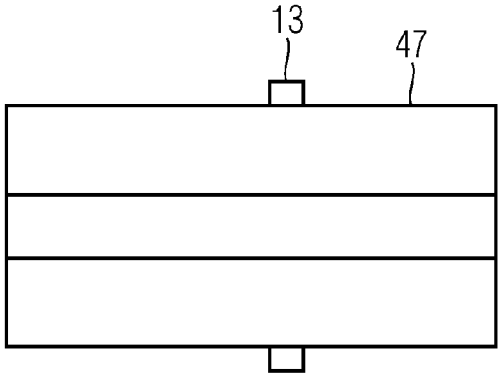
FIG. 9 shows an RF cavity formed as a coaxial line.

FIG. 9 shows an RF cavity which is formed as a coaxial conductive connection 47. RF power can be fed into the coaxial connection through the input coupling device 13 arranged on the outer conductor. The outer conductor of the coaxial connection 47, or its outer side, is protected against propagating RF currents by the shielding device.

Figure 10:
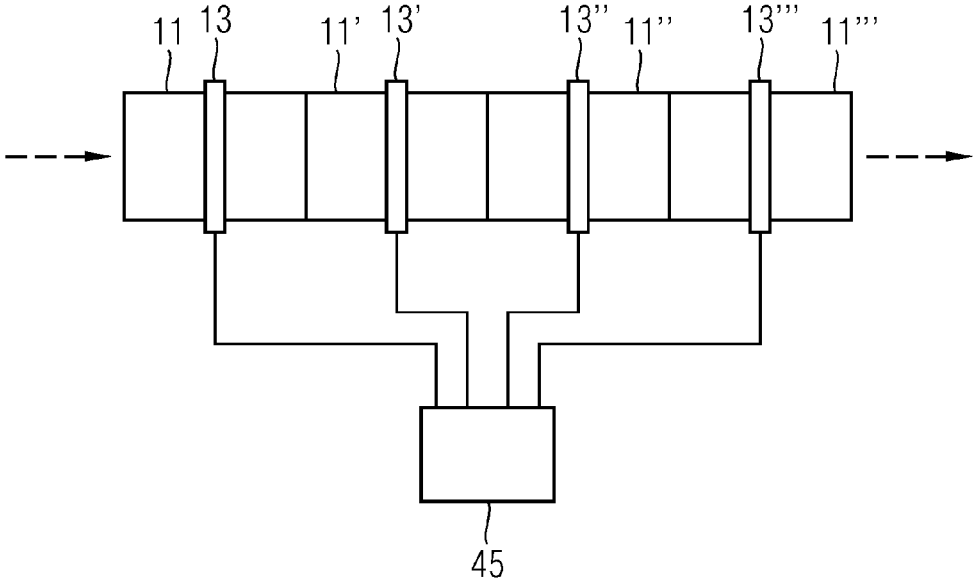
FIG. 10 shows an accelerator unit along which a multiplicity of RF cavities.

FIG. 10 shows an accelerator unit along which a multiplicity of RF cavities 11 . . . 11''', such as are shown for example in FIG. 1 and FIG. 2, are arranged in succession. Since RF currents propagate only on the inner side of the RF cavities 11 . . . 11''', the RF cavities 11 . . . 11''' are decoupled from one another in the radiofrequency range and can therefore be driven individually by a control device 45, so that flexible tuning of the RF cavities 11 . . . 11''' to a desired acceleration can be achieved.

LIST OF REFERENCES

11 RF cavity
13 input coupling device
15 conductive wall
17 outer side
19 inner side
21 first section
23 second section
25 flange
27 insulation
29 solid-state switch
29 solid-state transistor
31 supply line
33 ferrite ring
35 protective cage
37 recess
39 dielectric
41 fold
43 rib
45 control device
47 coaxial connection

The invention claimed is:

1. An RF cavity, comprising:

a chamber, a conductive wall that encloses the chamber and has an inner side and an outer side, and a switch arrangement comprising a plurality of solid-state switches arranged around a circumference of the conductive wall around the chamber at a particular location along an axial length of the chamber, wherein the solid-state switches are connected to the conductive wall such that RF currents are induced in the conductive wall when the switch arrangement is activated, as a result of which RF power is coupled into the chamber of the RF cavity, and a ring-shared shielding device located on the outer side of the conductive wall and extending around the circumference of the RF cavity, the shielding device configured to increase the impedance of a propagation path of RF currents along the outer side of the conductive wall such that the RF currents coupled into the conductive wall are suppressed on the outer side of the conductive wall and directed to the inner side of the conductive wall.

2. The RF cavity of claim 1, wherein:

the conductive wall comprises a first section and a second section insulated from the first section, and the shielding device comprises a first part and a second part, the first part being arranged on the first section of the conductive wall and the second part being arranged on the second section of the conductive wall.

3. The RF cavity of claim 2, wherein the insulation between the first section and the second section of the conductive wall comprises a vacuum seal.

4. The RF cavity of claim 1, wherein the shielding device comprises a ribbed conductive structure.

5. The RF cavity of claim 1, wherein the shielding device comprises a ferrite ring.

6. The RF cavity of claim 1, wherein the shielding device comprises λ/4 spur line.

7. The RF cavity of claim 1, wherein at least a part of the shielding device is sunk into a recess on the outer side of the conductive wall.

8. The RF cavity of claim 7, wherein a λ/4 spur line is formed by the recess in the conductive wall.

9. The RF cavity of claim 8, wherein the recess is filled with a dielectric.

10. The RF cavity of claim 8, wherein the λ/4 spur line is folded.

11. The RF cavity of claim 1, wherein the solid-state switches are enclosed by a protective cage connected to the outer side of the conductive wall at a connection location, such that the shielding device lies between the connection location and the position where the RF currents are coupled into the wall by the solid-state switches.

12. The RF cavity of claim 1, wherein at least a part of the shielding device is applied on the outer side of the conductive wall.

13. The RF cavity of claim 1, wherein the shielding device is formed by a conductive protective cage that encloses the solid-state switches and the inner side of which is ribbed.

14. The RF cavity of claim 1, wherein the RF cavity is formed as a coaxial electrical line.

15. The RF cavity of claim 1, wherein the RF cavity is formed as an RF resonator for accelerating particles.

16. An accelerator comprising:

a plurality of RF cavities, each comprising:

a chamber, a conductive wall that encloses the chamber and has an inner side and an outer side, and a switch arrangement comprising a plurality of solid-state switches arranged around a circumference of the conductive wall around the chamber at a particular location along an axial length of the chamber, wherein the solid-state switches are connected to the conductive wall such that RF currents are induced in the conductive wall when the switch arrangement is activated, as a result of which RF power is coupled into the chamber of the RF cavity, and a ring-shaped shielding device located on the outer side of the conductive wall and extending around the circumference of the RF cavity, the shielding device configured to increase the impedance of a propagation path of RF currents along the outer side of the conductive wall such that the RF currents coupled into the conductive wall are suppressed on the outer side of the conductive wall and directed to the inner side of the conductive wall.

* * * * *